United States Patent [19]

Mostosi

[11] 3,953,811

[45] Apr. 27, 1976

[54] CURRENT-LIMITING ELECTRIC SWITCH EXEMPT FROM BUMPS IN THE OPENING STAGE

[75] Inventor: Angelo Mostosi, Bergamo, Italy

[73] Assignee: Sace S.p.A. Construzioni Elettromeccaniche, Bergamo, Italy

[22] Filed: Oct. 15, 1974

[21] Appl. No.: 514,487

[30] Foreign Application Priority Data

Apr. 12, 1974 Italy ..... 21420/74

[52] U.S. Cl. ..... 335/16; 335/195

[51] Int. Cl.[2] ..... H01H 77/10

[58] Field of Search ..... 335/15, 16, 46, 193, 335/195

[56] References Cited

UNITED STATES PATENTS

| | | | |
|---|---|---|---|
| 3,343,108 | 9/1967 | Murai | 335/16 |
| 3,533,027 | 10/1970 | Hanafusa et al. | 335/195 |
| 3,887,888 | 6/1975 | Bayles et al. | 335/195 |

*Primary Examiner*—G. Harris

*Attorney, Agent, or Firm*—Diller, Brown, Ramik & Wight

[57] ABSTRACT

An electric switch is disclosed in which the swingable arms intended to approach and separate the fixed and movable contacts are a part of a linkage containing fixed and slidable pins, so that an overcurrent exceeding a preselected limit causes the contacts to be opened without rebounds. The existing, or specially provided clearances between the component parts of the linkage are exploited for providing yieldable end of stroke abutments for absorbing the shock of the contact-carrying arm.

1 Claim, 6 Drawing Figures

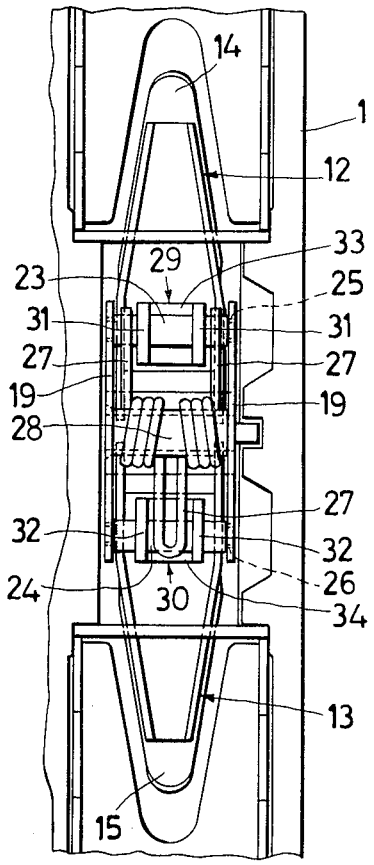
Fig.5
Fig.6
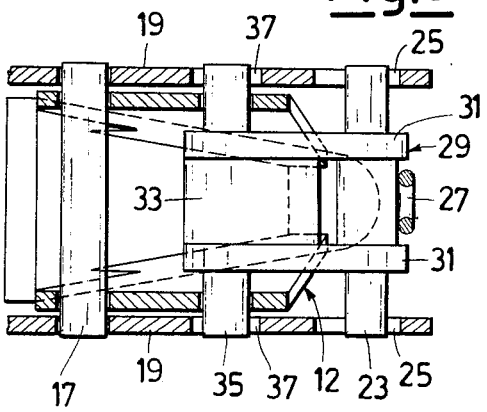

CURRENT-LIMITING ELECTRIC SWITCH EXEMPT FROM BUMPS IN THE OPENING STAGE

This invention relates to a current-limiting electric switch, which has the property of being exempt from bumps in its contact-opening stage.

There are known a few current-limiting electric switches for low voltages (of the so-called "in insulating box" type), which have the property of opening very quickly in the case of extremely high overcurrents, due for example to short-circuit conditions, due to the effect of the repulsive electrodynamic forces as generated by such overcurrents, by flowing therein in opposite directions, in the parallel and closely approached supports of the two contacts which cooperate in each current interruption.

While one of the two supports is usually fixed in space (and thus it supports the so-called "fixed contact"), the other support is, obviously, always movable (and thus it supports the so-called "movable contact") and is usually formed by a swingable arm which is retained in the closed position by resilient means which are so constructed and arranged as to counteract the circuit-opening electrodynamic forces during the initial portion of the rotation of the arm for the opening and then, once a dead centre has been overcome, it assists such electrodynamic forces during the final stage of the circuit-opening rotation aforementioned (that is, to prevent undesirable contact openings due to small overcurrents or to possible bumps in the closure stage, while simultaneously ensuring the due stability of the opening condition).

One of the major problems with which the manufacturers of electric switches of the kind referred to above are usually confronted, is the so-called bumps in the opening stage. Due to the high speed of contact opening it very often occurs, in fact, that the swingable arms which bear the movable contacts, by abruptly bumping against their relevant end of stroke abutments, bump backwards, and, by overcoming the bias of the resilient keeping means, are brought back to their closed position again.

An object of the present invention is exactly that of providing a current-limiting electric switch of the kind referred to above, which is wholly exempt from undesirable rebounds at the end of the opening stage.

This object is now achieved according to the invention by means of a current-limiting electric switch, which comprises at least one couple of electric contacts cooperating with one another and carried by their respective supporting members and electrically connected to a feeding terminal and a load terminal through an electric current path, of which, when the contacts are closed, said support form two parallel legs along which currents of opposite sign flow, so that a current rise above a preselected limiting value produces in said legs repulsive electrodynamic forces which are such as to overcome the bias of the retaining resilient means and to cause the supporting members to be mutually spread apart to separate the contacts, one at least of said supporting members being formed by a swingable arm on which said resilient retaining means act in such a way as to counteract said repulsive electrodynamic forces during the initial portion of the rotation for opening the contacts of said swingable arm and to assist, conversely, said electrodynamic forces during the final portion of said contact-opening rotation, characterized in that said resilient retaining means act upon said swingable arm with the intermediary of a pin which is slidably housed in a guide and connected to said arm by means of a connecting rod, the bias exerted by said resilient means upon said pin being such as to push the pin towards an end position of maximum closeness to the axis of rotation of the swingable arm, said connecting rod and said swingable arm being pivoted to one another at a pivotal point selected in such a way that an opening rotation of the swingable arm compels said pivotal point to be shifted from one side to the other of the line of conjunction between the axis of the pin and the axis of rotation of the swingable arm thus simultaneously causing a to-and-fro movement of the pin along said guide and towards said end position, said pin being so arranged that at the end of the contact-opening rotation of the swingable arm an abutting engagement is obtained between said pin and said swingable arm, said guide being extended in such a direction that said abutting engagement tends to bring said pin away from said end position again.

Field tests have clearly shown that in the switch according to the invention, the contact-opening motion of the swingable arm(s) which carry the movable contacts is controlled in a manner which is extremely efficient in order to prevent rebounds of the movable contacts towards the closed position. As a matter of fact, in tests effected with RMS currents up to 100 kA and over and peak currents up to about 250 kA, contact rebounds have never been experienced on completion of the contact-opening rotation as caused by very high currents such as those of short-circuiting.

It is a bit more intricate to explain the theoretical reasons for the results so achieved. It can be surmised, however, that at least two factors may contribute to the suppression of the rebounds: a first factor is the fact that the back-thrust as imparted to the slidable pin as the swingable arm bumps into the pin on completion of the contact-opening rotation of the arm would tend as itself actually to cause a backward displacement of the pivotal point between the connecting rod and the swingable arm, that is, a reversed rotation of the arm, but this tendency is positively and strongly biased, not only by the retaining resilient means, but also by the inertia with which the arm is still urged in the contact-opening rotation, so that the slidable pin is virtually prevented from being moved along its guide and thus the reverse rotation of the arm is prevented; a second factor is then the fact that on completion of its contact-opening rotation, the arm does not abut a fixed and rigid end of stroke (as in the switches known heretofore), but against a resiliently biased pin which, also exploiting the unavoidable and, if so desired, usefully increased clearances between the several component parts of the linkage, acts like a yieldable end of stroke which is capable of dampening the bump by the arm and thus of tendering the conditions which are essential to prevent the production of rebounds.

The constructional and functional features of the switch according to the invention will be better understood from the ensuing detailed description of a preferred embodiment of the invention which is illustrated by way of example by the accompanying drawings, wherein:

FIG. 5 is a front view of the switch in the position of FIG. 2, and

FIG. 6 shows said switch in cross-sectional view taken along the line VI—VI of FIG. 3.

Figure 1:
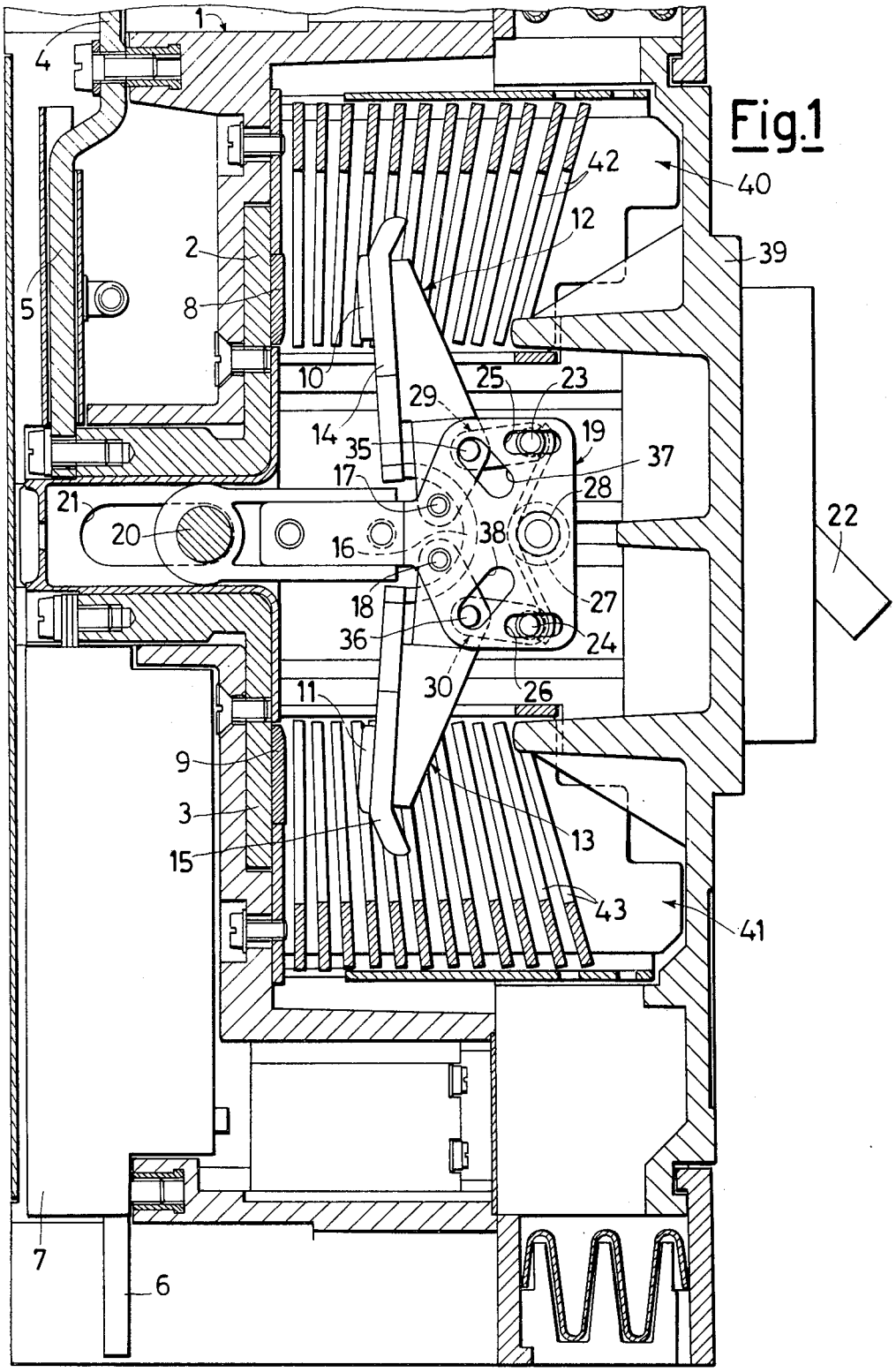
FIG. 1 shows, a cross-sectional view taken along a vertical plane, a switch according to the invention in the open position.

The switch (or, better to speak, the switch pole) shown in the drawings comprises (FIG. 1) a fixed framing 1, made of a dielectric material, which supports two bus bars 2 and 3, the first of which is electrically connected to a feeding terminal 4 via a conductor 5 and the second is electrically connected to a load terminal 6 through a conventional thermomagnetic release device 7 which is capable of automatically causing the opening of the switch whenever an overcurrent is detected above a preselected maximum level.

The bus bars 2 and 3 are the supporting members for two fixed contacts 8 and 9, with which cooperate, to open and close the circuit between the terminals 4 and 6, two movable contacts 10 and 11 carried by the respective supporting members 12 and 13 and electrically connected to one another by two bus bars 14 and 15 and by a flexible cable 16.

Figure 2:
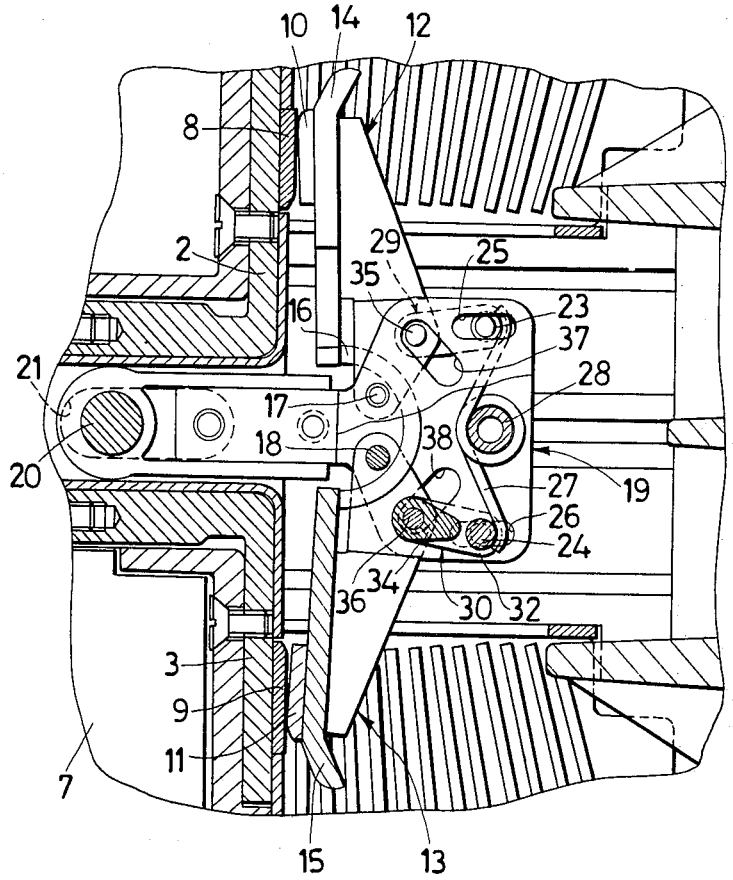
FIG. 2 shows the same switch in its closed position.

The two supporting members 12 and 13 for the movable contacts 10 and 11, are formed by swingable arms pivoted at 17 and 18, respectively, on a common supporting member 19, the latter being displaceable between the positions of FIG. 1 and FIG. 2 by causing a control shaft 20 to slide in a guiding slot 21 (FIG. 1). The shift of the shaft 20 from the position of FIG. 2 (closed switch) to that of FIG. 1 (open switch) can be controlled both automatically by the thermomagnetic release device 7, and manually through a manipulation lever 22 (FIG. 1), whereas the reverse shift (closure of the switch) can be controlled by the manipulation lever 22 only.

As can be seen in FIGS. 1, 2, 5 and 6, the common supporting member 19, having most commonly a U-shaped cross-sectional outline, also bears, both for rotation and sliding, two pins 23, 24, which are housed in their respective guiding slots 25, 26 and biased by a spring 27 in common for both pins, as wrapped around a central arbor 28 towards a position of maximum closeness to the pins 17, 18, about whose axles the swingable arms 12 and 13 can be rotated. The slidable pins 23, 24 are connected to the swingable arms 12, 13 by respective connecting rods 29, 30, each of which is formed by two side trunnions 31 (and 32) made as an entity by a connecting bridge 33 (and 34). The free ends of each pair of trunnions 31, 32 carry either of the respective slidable pins 23, 24, while the opposite ends (and thus the respective bridge 33, 34) carry either of the respective pins 35, 36 which provides the mutual pivotal relationship between a respective arm 12, 13 and the respective connecting rod 29, 30 and has its ends received in, and guided by, respective guiding slots 37, 38, these latter being formed in the common supporting member 19.

The switch as shown in the drawings is then completed by a lid of a dielectric material 39 which, mating the framing 1, provides two arc-control chambers 40, 41 which house, in addition to the movable contacts 10, 11, the respective sets of ferromagnetic plates for splitting the arc, 42 and 43.

In order to understand the mode of operation of the switch as shown in the drawings, it is assumed to regard as the starting position the one of FIG. 2, that is, the closed switch position, wherein the cooperating contacts 8, 10 and 9, 11 (kept pressed one against the other by the bias of the spring 27 upon the slidable pins 23 and 24 and thence, through the connecting rods 29 and 30, upon the swingable arms 12 and 13) ensure the closure of an electric current route going from the feeding terminal 4 to the load terminal 6 through the conductor 5, the bus bar 2, the fixed contact 8, the movable contact 10, the bus bar 14 of the swingable arm 12, the flexible cable 16, the bus bar 15 of the swingable arm 13, the movable contact 11, the fixed contact 9, the bus bar 3 and the thermomagnetic release device 7. Obviously, the supporting members 2 and 12 of the cooperating contacts 8 and 10, as well as the supporting members 3 and 13 of the cooperating contacts 9 and 11, form two parallel legs of the electric current route aforesaid, through which electric currents of opposite signs flow.

If, during the closure time of the switch no over-currents are experienced, or anyhow the possible over-currents are not at a level which is sufficiently high as to cause the release device 7 to enter action, the switch contacts remain in the closed position of FIG. 2 until such time as, by manipulating the manipulation lever 22, the shift of the control shaft 20 is manually effected for bringing the switch to the open position of FIG. 1.

If, conversely, at a certain stage, an overcurrent is experienced which has a not extremely high value but anyhow a value which is sufficient to cause the thermomagnetic release device 7 to enter action automatically, the latter device automatically causes a congruous displacement of the control shaft 20 towards the position of FIG. 1 and the consequential opening of the switch.

Lastly, and this is what is of outstanding interest herein, if in the circuit controlled by the switch shown in the drawings an overcurrent occurs which has an extremely high value such as that due to a short-circuit, that which requires that the thermomagnetic release device 7 may enter action in advance due to a differently controlled and much quicker break-away of the cooperating contacts 8-10 and 9-11, the repulsive electrodynamic forces then enter into play, as they are produced in the supporting members 2, 12 and 3, 13 of the above enumerated cooperating contacts due to the high currents of opposite signs which flow through the two couples of parallel circuit legs as formed by said supporting member, as outlined above, when the switch is closed.

Figure 4:
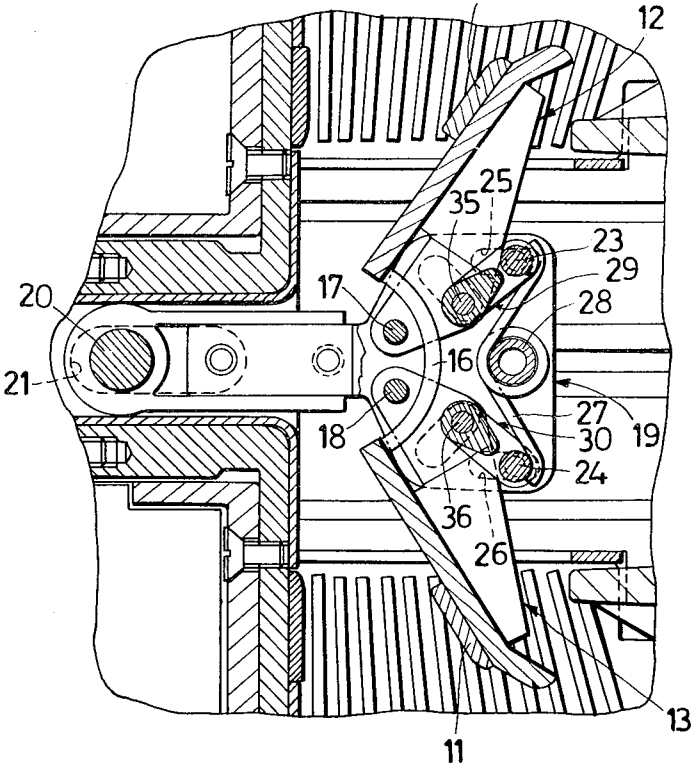
FIG. 4 shows the same switch at the end of its contact-opening motion aforementioned.
Figure 3:
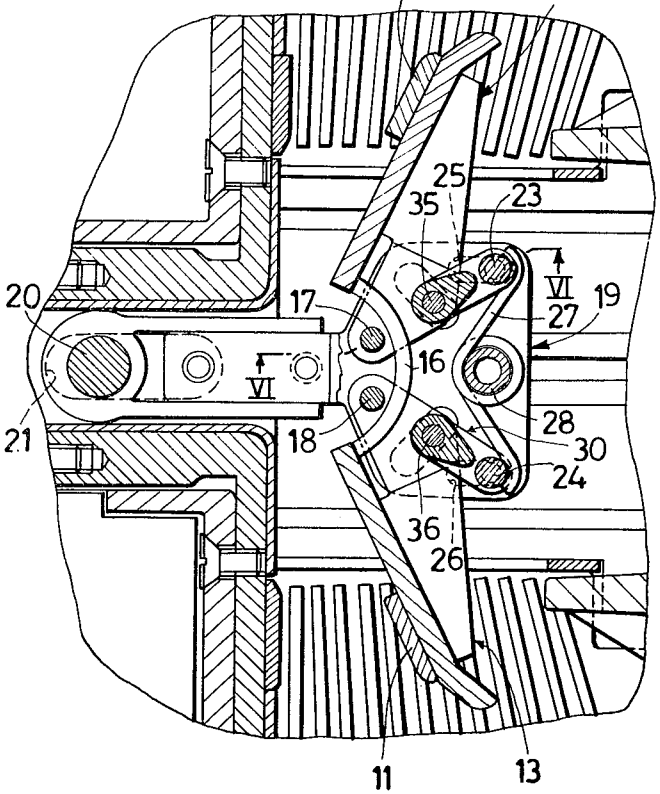
FIG. 3 shows the same switch in an intermediate stage of a contact-opening movement as caused by very high overcurrents.

Such electrodynamic repulsive forces exert on the swingable arms 12 and 13 an action tending to cause their clockwise and anticlockwise rotation, respectively, about the pins 17 and 18 in view of the obvious purpose and result of causing the separation of the cooperating contacts 8-10 and 9-11. If the overcurrents in question are actually high and more particularly above a preselected limiting value corresponding to the retaining bias imparted by the spring 27 to the swingable arms 12 and 13, such a rotation actually takes place and the result is to cause the displacement of the pivotal points 35 and 36 between the connecting rods 29, 30 and the arms 12, 13 on the one side and the other of the conjunction lines of the axis of the pins 23, 17, and 24, 18 (FIGS. 2 and 4) passing through the dead centers which are the places of coincidence of said pivotal points with said conjunction lines (FIG. 3). Such a displacement is accompanied by a to-and-fro movement of the slidable pins 23 and 24 along the guiding slots 25 and 26 toward and away of the respective positions of maximum closeness to the rotation pins 17 and 18 of the arms 12 and 13 (in practice, a toggle movement takes place for the levers 23-35, 35-17, and 24-36, 36-18, as allowed by the reciprocal motion of the pins 23,24).

Due to the effect of the mutual positions of the pins 23,35,17 and 24,36,18 during the initial stage (from the position of FIG. 2 to the position of FIG. 3) for the contact-opening rotation of the swingable arms 12 and 13, the bias exerted by the spring 27 upon the pins 23 and 24 is converted by the agency of the connecting rods 29 and 30 into a rotational thrust, anticlockwise and clockwise, respectively, as imparted to the arms 12 and 13, which counteracts the opposite thrust as produced by the repulsive electrodynamic forces, the result being that of hindering the contact-opening rotation of the arms 12 and 13. Once the dead centre has been overtaken as represented by the alignment of the pins 35,36 with the pins 23,24 and 17,18 (FIG. 3), the situation is reversed (FIG. 4), that is, the same bias exerted by the spring 27 is converted into a concordant rotational thrust which now assists, rather than hindering, the contact-opening rotation of the arms 12 and 13.

Said contact-opening rotation of the arms 12 and 13 is terminated at the instant where the back of the swingable arms 12 and 13 comes into abutting engagement with the pins 23 and 24, which cannot be pushed far from th fixed pins 17 and 18 since this fact would originate a backward displacement of the movable pins 35 and 36, and this is prevented by the inertia which is still possessed by the swingable arms 12 and 13 which are being rotated in the contact-opening direction. The engagement between the arms 12 and 13 and the pins 23 and 24 is thus an end-of-stroke engagement proper, whose result is the stoppage of the arms 12 and 13 in the contact-opening position.

As has already been pointed out in the initial portion of this disclosure, a number of field tests as already carried out have shown that the switches of the kind shown in the drawings are exempt from contact rebounds at the end of the contact-opening stage, that is, that the end-of-stroke abutment between the swingable arms 12 and 13, and the pins 23 and 24 does not cause rebounds of the swingable arms themselves which would be capable of causing the contacts to be closed again. Still as outlined above, this fact can be explained by the combination and the substantial balance of the contrary forces as applied to the pins 35 and 36 by the inertia of the arms 12 and 13 and their abutment against the slidable pins 23 and 24, and also by the dampening action imparted to the bumping arms 12 and 13 by the yieldable pins 23 and 24 with the aid of small and possibly specially increasable clearances between the several linkage points as defined by the pins 23, 24, by the pins 35, 36 and the pins 17, 18.

What I claim is:

1. A current-limiting electric switch, which comprises at least one couple of electric contacts cooperating with one another and carried by their respective supporting members and electrically connected to a feeding terminal and a load terminal through an electric current path, of which, when the contacts are closed, said support form two parallel legs along which currents of opposite sign flow, so that a current rise above a preselected limiting value produces in said legs repulsive electrodynamic forces which are such as to overcome the bias of the retaining resilient means and to cause the supporting members to be mutually spread apart to separate the contacts, one at least of said supporting members being formed by a swingable arm on which said resilient retaining means act in such a way as to counteract said repulsive electrodynamic forces during the initial portion of the rotation for opening the contacts of said swingable arm and to assist, conversely, said electro-dynamic forces during the final portion of said contact-opening rotation, characterized in that said resilient retaining means act upon said swingable arm with the intermediary of a pin which is slidably housed in a guide and connected to said arm by means of a connecting rod, the bias exerted by said resilient means upon said pin being such as to push the pin towards an end position of maximum closeness to the axis of rotation of the swingable arm, said connecting rod and said swingable arm being pivoted to one another at a pivotal point selected in such a way that an opening rotation of the swingable arm compels said pivotal point to be shifted from one side to the other of the line of conjunction between the axis of the pin and the axis of rotation of the swingable arm thus simultaneously causing a to-and-fro movement of the pin along said guide and towards said end position, said pin being so arranged that at the end of the contact-opening rotation of the swingable arm an abutting engagement is obtained between said pin and said swingable arm, said guide being extended in such a direction that said abutting engagement tends to bring said pin away from said end position again.

* * * * *